US009159521B1

(12) United States Patent
Chen et al.

(10) Patent No.: US 9,159,521 B1
(45) Date of Patent: Oct. 13, 2015

(54) LED AREA LIGHTING OPTICAL SYSTEM

(75) Inventors: Joe Zhuo Chen, Peachtree City, GA (US); Reed Alan Bradford, Peachtree City, GA (US); Megan Marie Christen, Sharpsburg, GA (US); Christopher Michael Bryant, Social Circle, GA (US); Evans Edward Thompson, III, Fairburn, GA (US)

(73) Assignee: Cooper Technologies Company, Houston, TX (US)

( * ) Notice: Subject to any disclaimer, the term of this patent is extended or adjusted under 35 U.S.C. 154(b) by 1347 days.

(21) Appl. No.: 12/794,544

(22) Filed: Jun. 4, 2010

(51) Int. Cl.
*F21V 13/04* (2006.01)
*F21V 7/00* (2006.01)
*H01J 21/02* (2006.01)

(52) U.S. Cl.
CPC ..... *H01J 21/02* (2013.01)

(58) Field of Classification Search
USPC ..... 362/297, 296.01, 249.02, 304, 346, 85, 362/243
See application file for complete search history.

(56) References Cited

U.S. PATENT DOCUMENTS

| | | | | |
|---|---|---|---|---|
| 5,703,719 | A | 12/1997 | Chen | |
| 6,244,728 | B1 | 6/2001 | Cote et al. | |
| 6,356,700 | B1 * | 3/2002 | Strobl | 385/147 |
| 6,364,506 | B1 | 4/2002 | Gallo | |
| 6,637,921 | B2 | 10/2003 | Coushaine | |
| 6,641,284 | B2 | 11/2003 | Stopa et al. | |
| 6,682,211 | B2 | 1/2004 | English et al. | |
| 6,814,475 | B2 | 11/2004 | Amano | |
| 2004/0037088 | A1 * | 2/2004 | English et al. | 362/545 |
| 2007/0285921 | A1 * | 12/2007 | Zulim et al. | 362/240 |
| 2009/0225543 | A1 | 9/2009 | Jacobson et al. | |

OTHER PUBLICATIONS

Perkin Elmer, Superior Chip-on-Board Technology for the most demanding LED applications, 2006, pp. 1-8, printed in Germany.
Seesmart LED, www.seesmartled.com/images/product/pdf/160013.pdf, 2010.

* cited by examiner

*Primary Examiner* — Mariceli Santiago
*Assistant Examiner* — Brenitra M Lee
(74) *Attorney, Agent, or Firm* — King & Spalding LLP

(57) ABSTRACT

A dual-reflector assembly includes an upper reflector and a lower reflector. The upper reflector includes a proximal end and a distal end. The lower reflector includes a proximal end and a distal end. A light source is positioned between the proximal ends of the upper reflector and the lower reflector. The upper reflector surrounds at least a portion of the lower reflector. The shape and orientation of the dual-reflector assembly can be formed by placing a cup reflector having an upper edge profile and a lower edge profile a predetermined distance away from a rotational axis and at a desired orientation, rotating the cup reflector around the rotational axis, obtaining the shape and orientation of the upper reflector and the lower reflector from the rotating upper edge profile and the rotating lower edge profile, respectively.

32 Claims, 6 Drawing Sheets

LED AREA LIGHTING OPTICAL SYSTEM

TECHNICAL FIELD

The present invention relates generally to optical systems for luminaires. More specifically, the present invention relates to an optical system for light emitting diode ("LED") based area lighting systems having multiple reflectors.

BACKGROUND

A luminaire is a system for producing, controlling, and/or distributing light for illumination. For example, a luminaire can include a system that outputs or distributes light into an environment, thereby allowing certain items in that environment to be visible. Luminaires are often referred to as "light fixtures". Conventional luminaires typically use conventional optical systems, including, a total internal reflection ("TIR") lens, a hybrid optical system which includes a refractor and a reflector combination system, and/or a single reflector, for obtaining a desired light distribution. A conventional LED area light fixture is one type of luminaire that provides illumination for a broad area. For example, the light emitted from conventional LED area light fixtures is directed entirely around the fixture and illuminates a relatively broad area. A LED system consisting of numerous discrete LED chips is generally used in conventional LED area light fixtures so that sufficient light is available to illuminate the broad area.

Conventional LED area light fixtures typically are manufactured using numerous discrete LED chips that are bundled together to collectively produce a desired output. In one example, 288 discrete LED chips, having an optic positioned over each discrete LED chip, are bundled together to collectively produce a 300 W LED source for the conventional high power LED area light fixture. Discrete LED chips are small enough so that they are treated as a point source when designing the refractor and/or the reflector around each of the discrete LED chips. Thus, the design for the refractor and/or the reflector is easier for achieving desired light distributions than when non-point source LED types, such as a chip-on-board LED package having multiple LED chips mounted therein, are used. Although the optical design is easier when bundling discrete LED chips together to form conventional LED light fixtures, these conventional LED light fixtures are not very efficient, have a higher manufacturing cost due to the number of LEDs and optics that are used, and generate a significant amount of heat that is dissipated to the surrounding environment.

Chip-on-board LED packages allow for bright, uniform light output. These packages typically have a low thermal resistance which enables low junction temperatures at the chip level, thereby resulting in higher efficiencies. In a chip-on-board package, there typically are two junctions for each LED chip, namely between the chip to the substrate and the substrate to the heat sink. Fewer LEDs and optics are used when using chip-on-board LED packages than when using discrete LED chips, thereby reducing manufacturing costs. In one example, about eight to ten LED chips are positioned on a chip-on-board LED package to produce a 300 W LED source. Thus, cost savings are achievable if chip-on-board LED packages are used within LED area light fixtures. However, since the chip-on-board LED package has a relatively large area, it cannot be treated as a point source when designing the refractor and/or the reflector around each of the chip-on-board LED packages. Designing a refractor and/or to achieve desired light distributions has been very difficult, causing chip-on-board LED packages to not typically be used within LED area light fixtures.

SUMMARY

One exemplary embodiment of the invention includes a dual-reflector assembly. The dual-reflector assembly can include an upper reflector, a lower reflector, and one or more light sources. The upper reflector can include an upper reflector proximal end and an upper reflector distal end. The lower reflector can include a lower reflector proximal end and a lower reflector distal end. The light source can be positioned substantially between the upper reflector proximal end and the lower reflector proximal end. At least a portion of the upper reflector can surround at least a portion of the lower reflector.

Another exemplary embodiment of the invention includes a luminaire. The luminaire can include a housing, a dual-reflector, and a driver. The housing can include an interior surface, an exterior surface, and a cavity formed therebetween. The housing can form an opening along the exterior surface. The dual-reflector assembly can be positioned within the housing. The dual-reflector assembly can include an upper reflector, a lower reflector, and a plurality of light sources. The upper reflector can include an upper reflector proximal end and an upper reflector distal end. The lower reflector can include a lower reflector proximal end and a lower reflector distal end. The light sources can be positioned substantially between the upper reflector proximal end and the lower reflector proximal end. The driver can be electrically coupled to the light sources. At least a portion of the upper reflector can surround at least a portion of the lower reflector. The light sources can emit light through the opening.

Another exemplary embodiment of the invention includes a method of forming a shape and orientation of a dual-reflector assembly that can include an upper reflector and a lower reflector. The method can include placing a reflector a predetermined distance away from a rotational axis. The reflector can include an upper edge profile and a lower edge profile. The method also can include orienting the reflector at a peak angle. The method also can include rotating the reflector around the rotational axis. Additionally, the method can include obtaining the shape and orientation of the upper reflector from the rotating upper edge profile and obtaining the shape and orientation of the lower reflector from the rotating lower edge profile.

BRIEF DESCRIPTION OF THE DRAWINGS

The foregoing and other features and aspects of the invention may be best understood with reference to the following description of certain exemplary embodiments, when read in conjunction with the accompanying drawings, wherein.

Figure 1A:
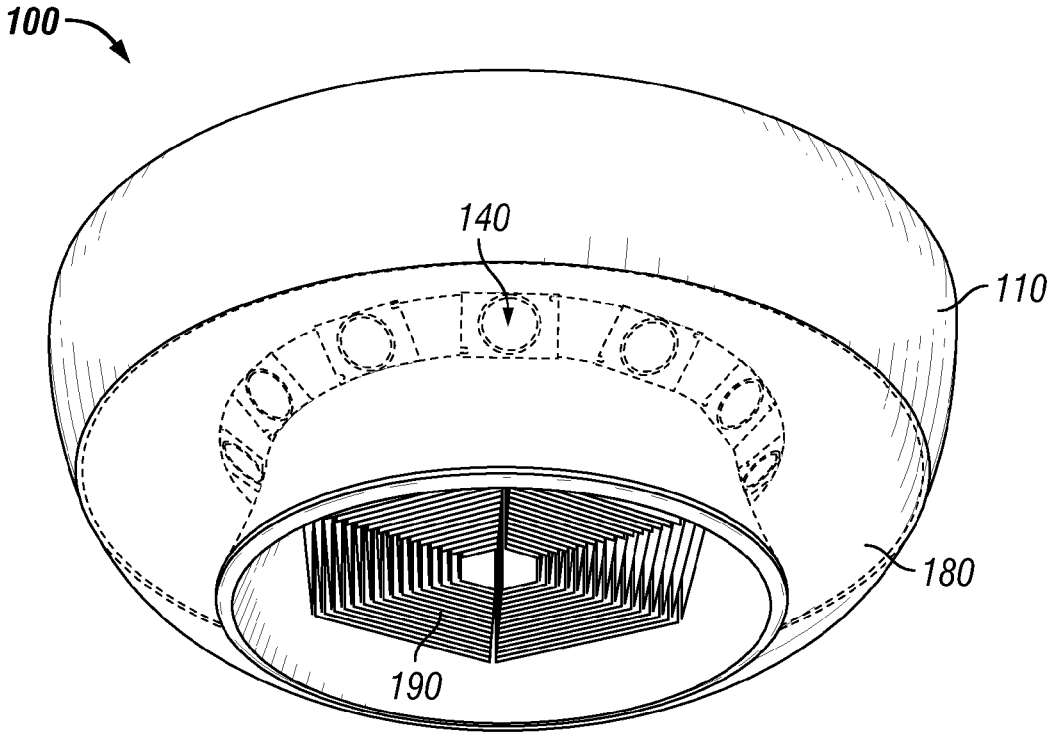
FIG. 1A is a perspective view of a high power LED area light fixture in accordance with an exemplary embodiment of the present invention.

The drawings illustrate only exemplary embodiments of the invention and are therefore not to be considered limiting of its scope, as the invention may admit to other equally effective embodiments.

BRIEF DESCRIPTION OF EXEMPLARY EMBODIMENTS

The disclosure is better understood by reading the following description of non-limiting, exemplary embodiments with reference to the attached drawings, wherein like parts of each of the figures are identified by like reference characters throughout, and which are briefly described below. Although the description of exemplary embodiments is provided below in conjunction with a chip-on-board LED package as a light source, alternate embodiments are applicable to other types of light sources including, but not limited to, discrete LED chips, organic LEDs, high intensity discharge ("HID") lamps, fluorescent lamps, compact fluorescent lamps ("CFLs"), and incandescent lamps.

Figure 1B:
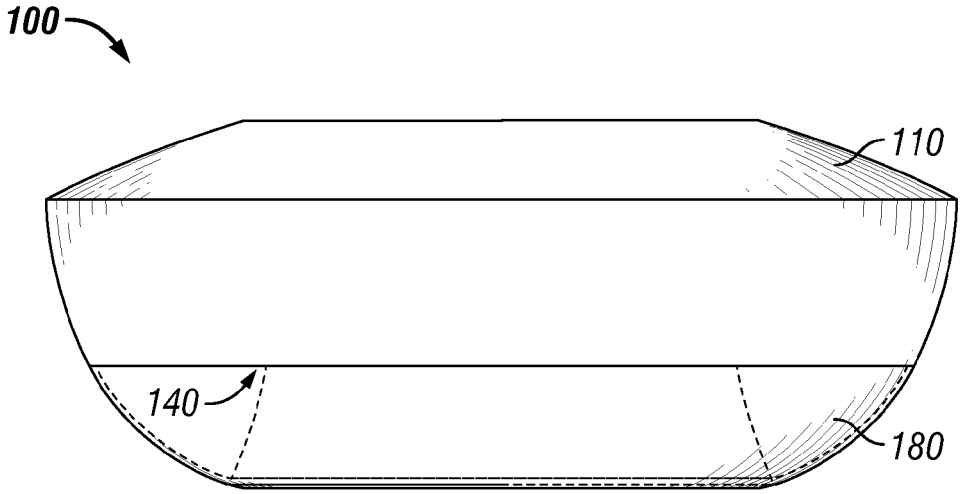
FIG. 1B is a side elevation view of the high power LED area light fixture of FIG. 1A in accordance with an exemplary embodiment of the present invention.
Figure 1C:
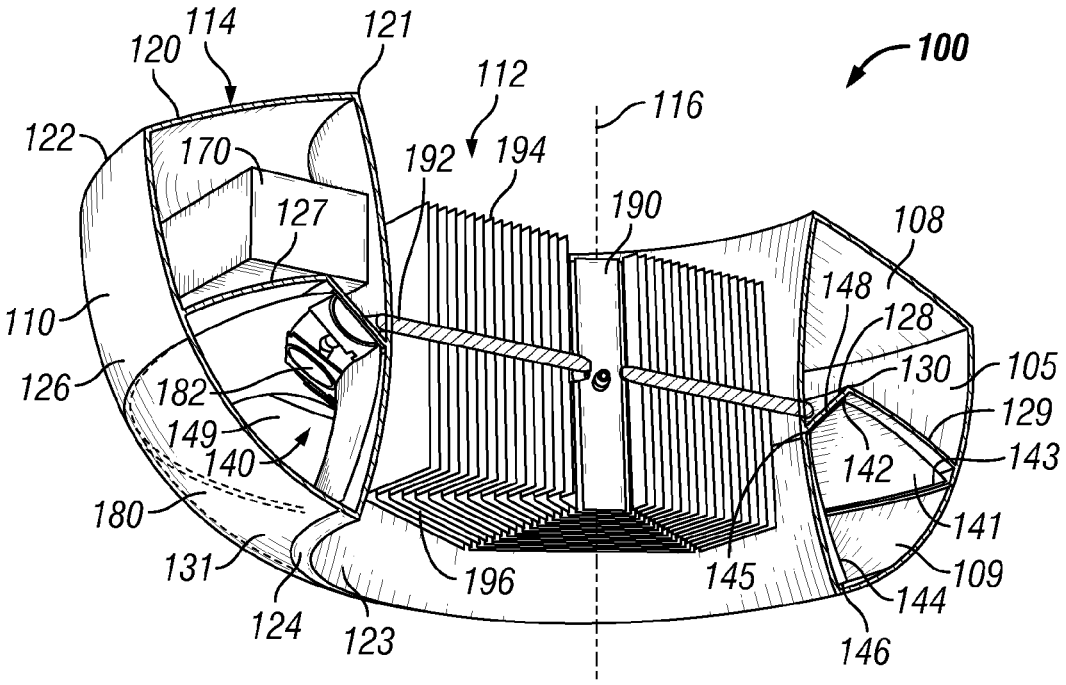
FIG. 1C is a cross-sectional view of the high power LED area light fixture of FIG. 1A in accordance with an exemplary embodiment of the present invention.

FIG. 1A is a perspective view of a high power LED area light fixture 100 in accordance with an exemplary embodiment of the present invention. FIG. 1B is a side elevation view of the exemplary high power LED area light fixture 100 of FIG. 1A. FIG. 1C is a cross-sectional view of the exemplary high power LED area light fixture 100 of FIG. 1A. Referring to FIGS. 1A-C, the high power LED area light fixture 100 includes a housing 110, a dual-reflector assembly 140, one or more drivers 170, a lens 180, one or more light sources 182, and a heat sink 190. In certain exemplary embodiments, the light sources 182 are chip-on-board LED packages. In addition, in certain exemplary embodiments, the lens 180 is an optional feature that is capable of being included or excluded from the fixture 100.

In certain exemplary embodiments, the housing 110 has a substantially circular shape and forms a passageway 112 extending therethrough. A housing central axis 116 extends through the passageway 112. In one exemplary embodiment, the housing 110 is rotationally symmetrical about the housing central axis 116. Although the exemplary housing 110 is rotationally symmetrical about the housing central axis 116, in alternative embodiments, the housing 110 is not rotationally symmetrical about the housing central axis 116. In addition, although the exemplary housing 110 has a circular shape, alternative embodiments of the housing 110 are capable of being any geometric or non-geometric shape.

The housing 110 includes a top surface 120, an interior surface 123, and an exterior surface 126. The top surface 120 has a interior edge 121 and an exterior edge 122. The interior surface 123 extends from the interior edge 121 of the top surface 120 in a downward direction and forms a lip 124 at its distal end that extends towards the exterior edge 122 of the top surface 120. The exterior surface 126 extends from the exterior edge 122 of the top surface 120 in a downward direction towards the lip 124. In certain exemplary embodiments, both the interior surface 123 and the exterior surface 126 have a curved shape. However, in alternative exemplary embodiments, one or more of the interior surface 123 and the exterior surface 126 are not curved. An opening 131 is formed between the exterior surface 126 and the lip 124 through which the lens 180 is optionally inserted and coupled thereto. The top surface 120, the interior surface 123, and the exterior surface 126 form a cavity 105 therein.

The housing 110 also includes a divider 127 that extends from a lower portion of the exterior surface 126 to about the middle to lower portion of the interior surface 123. The divider 127 separates the cavity 105 of the housing 110 into an upper compartment 108 and a lower compartment 109. The divider 127 includes a first member 128 and a second member 129. The first member 128 extends from about the middle to lower portion of the interior surface 123 in an upward and angular manner towards the top surface 120, while the second member 129 extends from about the lower portion of the exterior surface 126 in an upward and angular manner towards the interior surface 123. The first and second members 128 and 129 form an apex 130 oriented in a direction towards the top surface 120 where both members 128 and 129 meet.

In certain exemplary embodiments, the housing 110 is fabricated using sheet metal. Alternatively, the housing 110 is fabricated using other suitable materials known to those of ordinary skill in the art having the benefit of this disclosure including, but not limited to, aluminum, steel, other metals, metal alloys, plastics, polymers, or a combination thereof. In some exemplary embodiments, one or more portions of the housing 110 are fabricated using reflective materials or are made to be reflective, such as by polishing or by metalizing the surfaces.

The driver 170 is positioned within the upper compartment 108 and is securely mounted therein. In some exemplary embodiments, the driver is mounted to a mounting bracket (not shown) that is coupled to a portion of the housing 110. In other exemplary embodiments, the driver 170 is directly mounted to a portion of the housing 110. Although the exemplary driver 170 is positioned within the upper compartment 108, in alternative embodiments, the driver 170 is positioned outside the housing 110. The driver 170 provides electrical power and control to one or more light sources 182, such as discrete LEDs or chip-on-board LED packages, that are positioned within the bottom compartment 109 using one or more electrical wires (not shown). In one example, the electrical wires pass through one or more openings (not shown) formed in the divider 127 to electrically couple the driver 170 to the light sources 182. In certain alternative embodiments, several drivers 170 are mounted within the upper compartment 108 and each driver 170 provides electrical power to one or more light sources 182 so that the direction, color, and intensity of light emitted by each light source 182 or groups of light sources 182 is individually controlled by one of the drivers 170. In some exemplary embodiments, the drivers 170 vary the amount of power delivered to the light sources 182, thereby causing the light sources 182 to emit more or less light. Also, in certain exemplary embodiments, the drivers 170 control the light sources 182 in such a way that the light sources 182 turn on and off intermittently, thereby making the light sources 182 blink or appear to be dimmed.

The exemplary lens 180 is fabricated using an acrylic material. In alternative embodiments, the lens 180 is fabricated using any other suitable material known to people having ordinary skill in the art. The lens 180 is coupled to the housing 110 so that the lens 180 covers the opening 131 formed between the exterior surface 126 and the lip 124. In certain exemplary embodiments, the lens 180 is coupled to the housing 110 using methods, such as snap-fitting the lens 180 into a track or applying adhesives to the edges of the lens 180. In some exemplary embodiments, the lens 180 provides a uniform curvature that extends from the top surface's exterior edge, along the exterior surface 126, and to the lip 124. The lens 180 provides protection to the performance of the light fixture 100 by sealing out dust, insects, and other environmental contaminants that diminish optical performance. In certain exemplary embodiments, the lens 180 is smooth on both surfaces. Alternatively, the lens 180 includes prisms and/or facets on one or both surfaces to control the light output from the light fixture 100. Furthermore, in certain exemplary embodiments, the lens 180 acts as a diffuser.

The heat sink 190 is thermally coupled to at least a portion of the housing 110 and is either directly and/or indirectly coupled to the housing 110. In certain exemplary embodiments, the heat sink 190 is coupled indirectly to the first member 128 and passes through the interior surface 123 of the housing 110 and includes one or more heat pipes 192 and one or more sheet fins 194 positioned outside of the housing 110 and within the passageway 112. However, in certain alternative exemplary embodiments, the sheet fins 194 or a portion of the sheet fins 194 are positioned within the housing 110 or positioned outside the housing 110, but not within the passageway 112.

The heat pipes 192 provide a pathway for transferring at least a portion of the heat built up in the housing 110 from the operation of the light sources 182 to the sheet fins 194. In one exemplary embodiment, each heat pipe 192 includes a sealed pipe or tube made of a thermally conductive material, such as copper or aluminum. A cooling fluid (not shown), such as water, ethanol, acetone, sodium, or mercury, is disposed inside the heat pipes 192. Each heat pipe 192 includes a first end disposed within the housing 110 and adjacent to the first member 128. The heat pipes 192 extend from the first member 128 towards the exemplary sheet fins 194, which are positioned outside of the housing 110. Evaporation and condensation of the cooling fluid causes thermal energy to transfer from a first, higher temperature portion of the heat pipe 192 (proximate one or more corresponding light sources 182) to a second, lower temperature portion of the heat pipe 192 (away from the one or more corresponding light sources 182).

The transferred heat is dissipated from the heat pipe 192 through convection and/or conduction. In one exemplary embodiment, the number and size of the heat pipes 192 depend on the desired amount of heat energy to be dissipated, the size of the housing 110, cost considerations, and other financial, operational, and/or environmental factors known to a person of ordinary skill in the art having the benefit of this disclosure. In certain exemplary embodiments, one or more sheet fins 194 are coupled to each heat pipe 192 or coupled around the collection of heat pipes 192 to help dissipate the transferred heat. In some exemplary embodiments, an air gap 196 is disposed between each of the sheet fins 194 to allow air to flow between one or more of the sheet fins 194 and remove heat from the sheet fins 194 by way of convection.

According to some exemplary embodiments, the heat sink 190 further includes one or more active cooling modules (not shown), such as a SYNJET™ brand module offered by Nuventix, Inc., coupled to one or more of the heat pipes 192. In some exemplary embodiments, the active cooling modules generate an air flow to increase the amount of air flowing between the heat pipes 192 and/or sheet fins 194 and increase the amount of convective cooling that takes place. In certain exemplary embodiments, each active cooling module expels high momentum pulses of air for spot cooling the heat pipes 192, sheet fins 194, and/or other components of the light fixture 100.

The dual-reflector assembly 140 includes an upper reflector 141 having a proximal end 142 and a distal end 143, a lower reflector 144 having a proximal end 145 and a distal end 146, and one or more substrates 148 extending from at least portions of the upper reflector's proximal end 142 to at least portions of the lower reflector's proximal end 145. The upper reflector 141, the lower reflector 144, and the substrate 148 form a cavity 149 therein. One or more light sources 182 are mountable to the substrate 148 and are oriented to direct light towards the area between the upper reflector's distal end 143 and the lower reflector's distal end 146 thereby providing illumination to a desired direction.

In certain exemplary embodiments, each light source 182 includes one or more arrays of LEDs that are collectively configured as a chip-on-board that produces a lumen output from 1 to 5000 lumens. The exemplary light sources 182 are positioned in a circular array within the dual-reflector assembly 140 on the substrate 148. The number of light sources 182 ranges from about four to about two hundred depending upon the size of the light fixture 100. In the exemplary embodiments wherein the light sources 182 are chip-on-board LED packages, the chip-on-board LED packages are attached to the substrate 148 by one or more solder joints, plugs, epoxy or bonding lines, and/or other means for mounting an electrical/optical device on a surface. The substrate 148 is electrically connected to support circuitry (not shown) and/or the LED driver 170 for supplying electrical power and control to the light sources 182. For example, one or more wires (not shown) couple opposite ends of the substrate 148 to the LED driver 170, thereby completing a electrical circuit between the LED driver 170, substrate 148, and light sources 182. In certain exemplary embodiments, the LED driver 170 is configured to separately control one or more portions of the LEDs in the array to adjust light color or intensity.

According to this exemplary embodiment, the substrate 148 includes one or more sheets of ceramic, metal, laminate, circuit board, Mylar®, or another material. Each LED includes a chip of semi-conductive material that is treated to create a positive-negative ("p-n") junction. When the chip-on-board LED package is electrically coupled to a power source, such as the LED driver 170, current flows from the positive side to the negative side of each junction, causing charge carriers to release energy in the form of incoherent light.

The wavelength or color of the emitted light depends on the materials used to make the LED. For example, a blue or ultraviolet LED typically includes gallium nitride ("GaN") or indium gallium nitride ("InGaN"), a red LED typically includes aluminum gallium arsenide ("AlGaAs"), and a green LED typically includes aluminum gallium phosphide ("AlGaP"). Each of the LEDs in the chip-on-board LED package can produce the same or a distinct color of light. For example, in certain exemplary embodiments, the chip-on-board LED package includes one or more white LED's and one or more non-white LEDs, such as red, yellow, amber, or blue LEDs, for adjusting the color temperature output of the light emitted from the light fixture 100. A yellow or multi-chromatic phosphor coats or otherwise is used in a blue or ultraviolet LED to create blue and red-shifted light that essentially matches blackbody radiation. The emitted light approximates or emulates "white," incandescent light to a human observer. In certain exemplary embodiments, the emitted light includes substantially white light that seems slightly blue, green, red, yellow, orange, or some other color or tint. In certain exemplary embodiments, the light emitted from the chip-on-board LED package has a color temperature between 2500 and 5000 degrees Kelvin.

In certain exemplary embodiments, an optically transmissive or clear material (not shown) encapsulates at least a portion of each LED or chip-on-board LED package. This encapsulating material provides environmental protection while transmitting light from the chip-on-board LED package. In certain exemplary embodiments, the encapsulating material includes a conformal coating, a silicone gel, a cured/curable polymer, an adhesive, or some other material known to a person of ordinary skill in the art having the benefit of the present disclosure. In certain exemplary embodiments, phosphors are coated onto or dispersed in the encapsulating material for creating white light. In certain exemplary embodiments, the white light has a color temperature between 2500 and 5000 degrees Kelvin.

The dual-reflector assembly 140 is positioned within the bottom compartment 109 so that the substrate 148 is positioned adjacent the first member 128, the upper reflector 141 is positioned adjacent the second member 129, and the lower reflector 144 is positioned adjacent the lower portion of the interior surface 123. In some exemplary embodiments, the lower portion of the interior surface 123 forms the lower reflector 144 and/or the second member 129 forms the upper reflector 141. The opening 131 is aligned with the cavity 149.

The exemplary upper reflector 141 and the lower reflector 144 are fabricated from sheet metal. Alternatively the reflectors 141, 144 are fabricated from any other suitable material known to people having ordinary skill in the art, including, but not limited to spun aluminum, turned aluminum, or any other known high reflectance material. When using plastic material, at least a portion of the plastic material that is used to reflect light is coated with a metallic material, such as aluminum or stainless steel. In certain exemplary embodiments the upper reflector 141 is made of the same material as the lower reflector 144. In one example, the material is shaped into the reflectors 141, 144 using a spinning process or a hydro-forming process when using sheet metal. In another example, the high reflectance material is shaped into the reflectors 141 and 144 using a thermoforming process.

Figure 2:
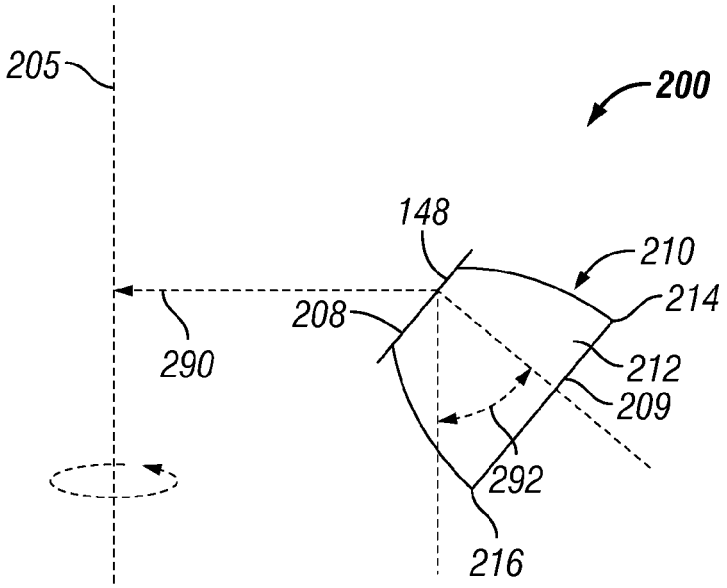
FIG. 2 is a graphical representation for a method of deriving the shape of a dual-reflector assembly of FIG. 1C in accordance with an exemplary embodiment of the present invention.

FIG. 2 shows a graphical representation 200 for a method of deriving the shape of the dual-reflector assembly 140 (FIG. 1C) in accordance with an exemplary embodiment of the present invention. Referring to FIGS. 1C and 2, the exemplary graphical representation 200 includes a reflector cup 210, the substrate 148, and a proposed dual-reflector assembly axis 205, or rotational axis. In one exemplary embodiment, the rotational axis becomes the same as the housing central axis 116 once the dual-reflector assembly 140 is positioned within the housing 110. The reflector cup 210 provides a shape, which is substantially cup-shaped, that efficiently collimates the light that is discharged through it from the light source 182. However, in other exemplary embodiments, a different shaped reflector is used to form the upper reflector and the lower reflector. The reflector cup 210 includes a proximal opening 208 at one end and a distal opening 209 at an opposing end. The substrate 148 is positioned over the proximal opening 208.

The reflector cup 210 also is positioned at a predetermined distance 290 away from the proposed dual-reflector assembly axis 205 and oriented at a predetermined angle 292 or desired peak angle. According to one exemplary embodiment, the predetermined distance 290 is about 5.5 inches; however, the predetermined distance 290 is larger or smaller depending upon illumination requirements and the size of the housing 110. Also, according to one exemplary embodiment, the predetermined angle 292 is approximately a forty degree angle from the vertical pointing downward, which provides a shape and orientation of the dual-reflector assembly 140 for a high-bay type lighting fixture 100. According to another exemplary embodiment, the predetermined angle 292 is about fifty degrees from the vertical pointing downward, which provides a shape and orientation of the dual-reflector assembly for a low-bay type lighting fixture. In alternative exemplary embodiments, the predetermined angle 292 ranges from about twenty degrees to about seventy degrees from the vertical pointing downward. The predetermined angle 292 is variable and allows for providing different peak beam angles. The predetermined angle 292 is dependent upon the desired spread of light, where a higher predetermined angle 292 provides a larger spread of light while a smaller predetermined angle 292 provides a smaller spread of light.

The reflector cup 210 and the substrate 148 are oriented so that a reflector cup profile 212 is observable. The reflector cup profile 212 includes an upper-cup profile edge 214 and a lower-cup profile edge 216. The upper-cup profile edge 214 and the lower-cup profile edge 216 both have a parabolic shape and extend from opposite sides of the proximal opening 208 to opposite sides of the distal opening 209. To form the shape and orientation of the upper reflector 141, the upper-cup profile edge 214 is rotated about the proposed dual-reflector assembly axis 205 while maintaining the same distance from the proposed dual-reflector assembly axis 205 and the same orientation during the rotation.

To form the shape and orientation of the lower reflector 144, with respect to the upper reflector 141, the lower-cup profile edge 216 is rotated about the proposed dual-reflector assembly axis 205 while maintaining the same distance from the proposed dual-reflector assembly axis 205 and the same orientation during rotation. In certain exemplary embodiments, the predetermined angle 292, or orientation, is constant as the reflector cup 210 is rotated around the proposed dual-reflector assembly axis 205. In alternative embodiments, the predetermined angle 292 or orientation is variable as the reflector cup 210 is rotated around the proposed dual-reflector assembly axis 205. In certain exemplary embodiments, the predetermined distance 290 is maintained constant as the reflector cup 210 is rotated around the proposed dual-reflector assembly axis 205; however, the predetermined distance 290 is variable as the reflector cup 210 is rotated around the proposed dual-reflector assembly axis 205 in other exemplary embodiments. Additionally, in certain exemplary embodiments, the length of the upper-cup profile edge 214 and the lower-cup profile edge 216 is maintained constant as the reflector cup 210 is rotated around the proposed dual-reflector assembly axis 205. Alternatively, the length of at least one of the upper-cup profile edge 214 and/or the lower-cup profile edge 216 is variable as the reflector cup 210 is rotated around the proposed dual-reflector assembly axis 205.

As previously mentioned, once the upper and lower reflectors are formed, one or more substrates 148 are positioned so that they extend from at least portions of the upper reflector's proximal end 142 to at least portions of the lower reflector's proximal end 145. In one exemplary embodiment, the substrates 148 are positioned in an equidistant manner around the proximal ends 142 and 145 of the upper and lower reflectors 141 and 144. Alternatively, the substrates 148 are positioned in a non-equidistant manner.

Figure 3A:
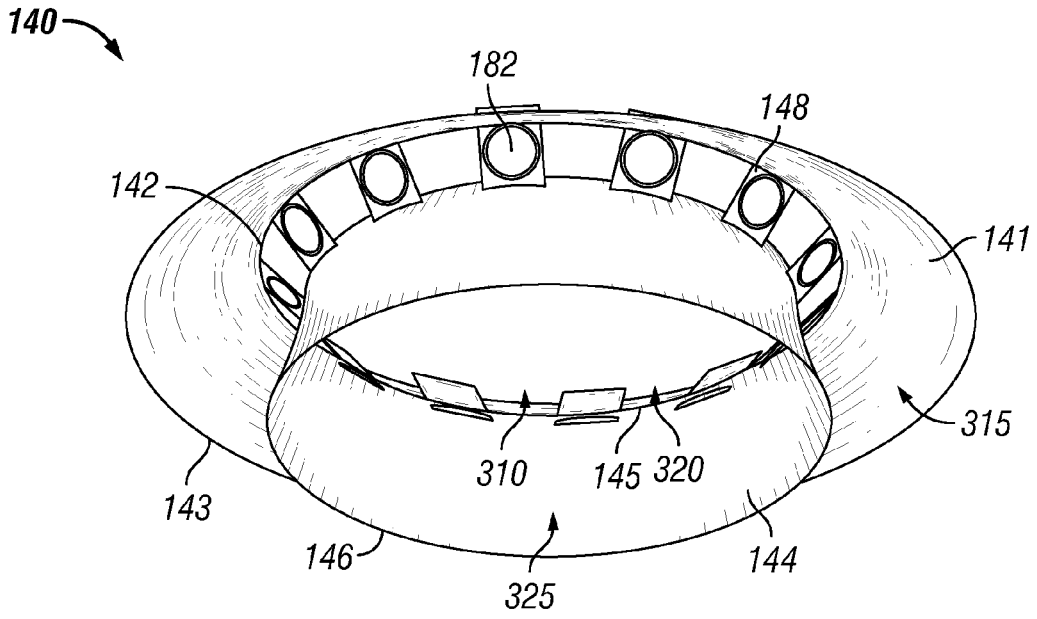
FIG. 3A is a perspective view of the dual-reflector assembly of FIG. 1C in accordance with an exemplary embodiment of the present invention.
Figure 3B:
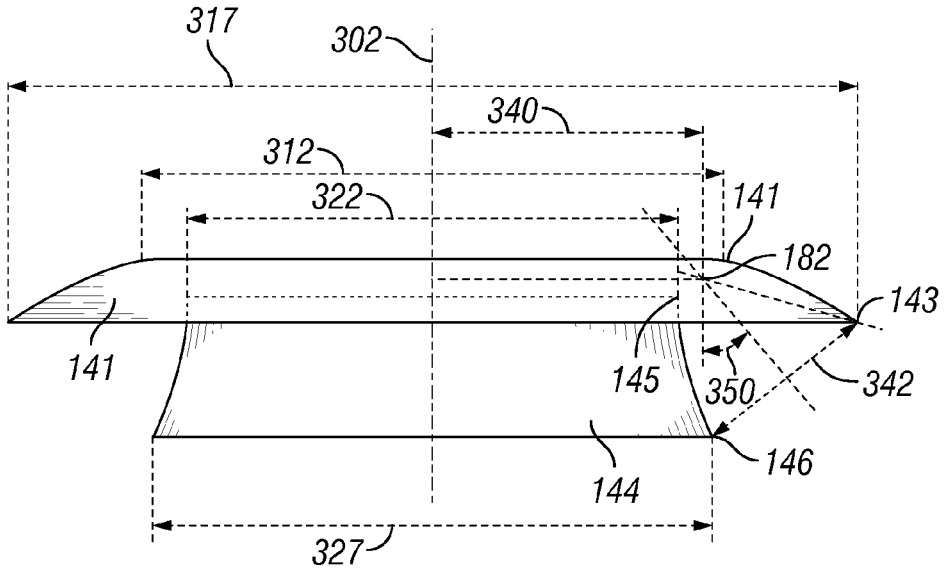
FIG. 3B is a side elevation view of the dual-reflector assembly of FIG. 1C in accordance with an exemplary embodiment of the present invention.

FIG. 3A is a perspective view of the dual-reflector assembly 140 of FIG. 1C in accordance with an exemplary embodiment of the present invention. FIG. 3B is a side elevation view of the dual-reflector assembly 140 of FIG. 1C. Referring to FIGS. 1C, 3A, and 3B, the dual-reflector assembly 140 includes the upper reflector 141, the lower reflector 144, and one or more substrates 148.

As previously mentioned, the upper reflector 141 includes the proximal end 142 and the distal end 143 and is shaped substantially similar to a saucer; however, other geometric or non-geometric shapes are available in alternative exemplary embodiments. The proximal end 142 of the upper reflector 141 forms an upper reflector proximal opening 310, while the distal end 143 of the upper reflector 141 forms an upper reflector distal opening 315. The upper reflector proximal opening 310 includes an upper reflector proximal opening diameter 312 and the upper reflector distal opening 315 includes an upper reflector distal opening diameter 317.

Similarly, the lower reflector 144 includes the proximal end 145 and the distal end 146 and is shaped substantially similar to a concave-shaped cylinder; however, other geometric or non-geometric shapes are available in alternative exemplary embodiments. The proximal end 145 of the lower reflector 144 forms a lower reflector proximal opening 320, while the distal end 146 of the lower reflector 144 forms a lower reflector distal opening 325. The lower reflector proximal opening 320 includes a lower reflector proximal opening diameter 322 and the lower reflector distal opening 325 includes a lower reflector distal opening diameter 327. In one exemplary embodiment, the profile of the combined upper reflector 141 and lower reflector 144 is substantially parabolic. However, other geometric or non-geometric profile shapes are used in alternative exemplary embodiments.

According to one exemplary embodiment, the lower reflector's proximal end 145 is positioned within a horizontal plane that is higher than the horizontal plane that the upper reflector's distal end 143 is positioned within. However, in alternative exemplary embodiments, the lower reflector's proximal end 145 is positioned within a horizontal plane that is the same or lower than the horizontal plane that the upper reflector's distal end 143 is positioned within. Additionally, the lower reflector proximal opening 320 is centrally positioned within the vertical profile of the upper reflector proximal opening 310 so that each of the lower reflector proximal opening 320 and the upper reflector proximal opening have the same reflector axis 302, which, in certain exemplary embodiments, is the same as the housing central axis 116 once the dual-reflector assembly 140 is positioned within the housing 110.

In an exemplary embodiment, the upper reflector proximal opening diameter 312 is about twelve inches, the upper reflector distal opening diameter 317 is about 17.4 inches, the lower reflector proximal opening diameter 322 is about 10.1 inches, and the lower reflector distal opening diameter 327 is about 11.6 inches. The distance 340 of the chip-on-board LED package 182 on the substrate 148 is about 5.5 inches from the reflector axis 302. The distance 342 between the upper reflector's distal end 143 and the lower reflector's distal end 146 is about 3.8 inches. In this embodiment, the chip-on-board LED package 182 is positioned at an LED angle 350, which is about forty degrees. Thus, the dual-reflector assembly 140 is designed for a high-bay, high power LED area light fixture 100. As previously mentioned, the dimensions and angles are variable in other exemplary embodiments, and alternatively are designed for a low-bay, high power LED area light fixture 100.

In the exemplary embodiment, there are twelve substrates 148 positioned equidistant around the area formed between the upper reflector proximal end 142 and the lower reflector proximal end 145. However, in other exemplary embodiments, the substrates 148 are not positioned equidistantly around the area formed between the upper reflector proximal end 142 and the lower reflector proximal end 145. Additionally, the number of substrates 148 are variable from one to about two hundred in other exemplary embodiments.

Figure 4:
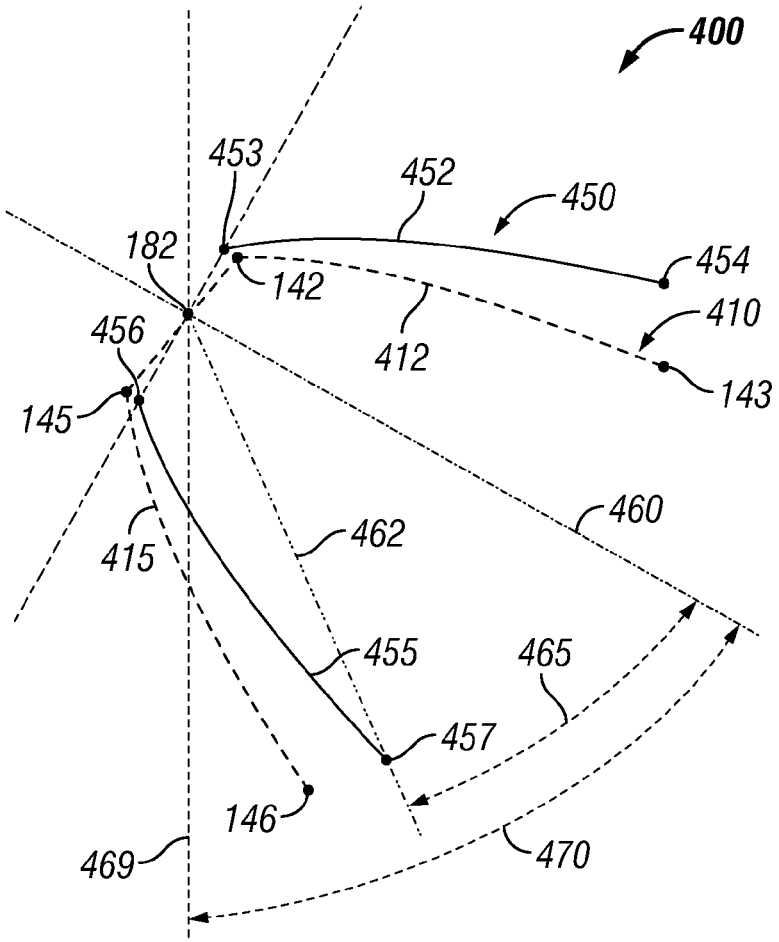
FIG. 4 presents a comparison of a portion of a high-bay profile and a portion of a low-bay profile in accordance with an exemplary embodiment of the present invention.

FIG. 4 presents a comparison of a portion of a high-bay profile 410 and a portion of a low-bay profile 450 in accordance with an exemplary embodiment of the present invention. The portion of a high-bay profile 410 is from the dual-reflector assembly 140 (FIG. 1C), which is designed for the high-bay, high power LED area light fixture 100 (FIG. 1C). The low-bay profile 450 is from a dual-reflector assembly (not shown) designed for a low-bay, high power LED area light fixture (not shown). Each of the profiles 410 and 450 are substantially cup-shaped. The difference between the high-bay, high power LED area light fixture 100 (FIG. 1C) and the low-bay, high power LED area light fixture is the shape and orientation of the dual-reflector assembly 140 (FIG. 1C) and the orientation that the chip-on-board LED package 182 is positioned. The high-bay, high power LED area light fixture 100 (FIG. 1C) is designed to be positioned on a higher ceiling than the low-bay, high power LED area light fixture.

Referring to FIG. 4, the low-bay cross-sectional view profile 450 includes a low-bay upper cross-sectional profile edge 452 and a low-bay lower cross-sectional profile edge 455. The low-bay upper cross-sectional profile edge 452 illustrates the shape and orientation of the upper reflector when designed for the low-bay, high power LED area light fixture. The low-bay lower cross-sectional profile edge 455 illustrates the shape and orientation of the lower reflector, with respect to the upper reflector, when designed for the low-bay, high power LED area light fixture. An axis 460 is formed, which passes through the center point between a low-bay upper reflector's proximal end 453 and a low-bay lower reflector's proximal end 456 and the center point between a low-bay upper reflector's distal end 454 and the low-bay lower reflector's distal end 457. A first angle 465 is formed between the axis 460 and a line 462 formed between the center point between the low-bay upper reflector's proximal end 453 and the low-bay lower reflector's proximal end 456 and the low-bay lower reflector's distal end 457. According to one exemplary embodiment, the first angle 465 is about thirty-five degrees However, the first angle 465 is greater or lesser in other exemplary embodiments. Additionally, a second angle 470 is formed between the axis 460 and a perpendicular line 469. According to one exemplary embodiment, the second angle 470 is about fifty degrees. However, the second angle 470 is greater or lesser in other exemplary embodiments.

The high-bay profile 410 includes a high-bay upper profile edge 412 and a high-bay lower profile edge 415. The high-bay upper profile edge 412 illustrates the shape and orientation of the upper reflector 141 (FIG. 1C) when designed for the high-bay, high power LED area light fixture 100 (FIG. 1C). The high-bay lower profile edge 415 illustrates the shape and orientation of the lower reflector 144 (FIG. 1C) when designed for the high-bay, high power LED area light fixture 100 (FIG. 1C). An axis (not shown) is formed, which passes through the center point between the upper reflector's proximal end 142 and the lower reflector's proximal end 145 and the center point between the upper reflector's distal end 143 and the lower reflector's distal end 146. A third angle (not shown), which is similar to first angle 465, is formed between the axis and a line (not shown) formed between the center point between the upper reflector's proximal end 142 and the lower reflector's proximal end 145 and the lower reflector's distal end 146. According to one exemplary embodiment, the third angle also is about thirty-five degrees. However, the third angle is greater or lesser in other exemplary embodiments. Additionally, a fourth angle (not shown) is formed between the axis and the perpendicular line 469. According to one exemplary embodiment, the fourth angle is about forty degrees; however, the fourth angle is greater or lesser in other exemplary embodiments.

Referring to FIGS. 1A-4, the exemplary dual-reflector assembly 140 is rotationally symmetric about the housing central axis 116 and provides for a substantially circular illumination pattern. The various illumination patterns are achieved by varying at least one of the length of the upper reflector 141, the orientation of the upper reflector 141, the length of the lower reflector 144, or the orientation of the lower reflector 144. For example, the length of the upper reflector 141 and the lower reflector 144 are extended to collect more light and direct more light to the desired peak angle. If the combined orientation of the upper reflector 141 and the lower reflector 144 is directed at a smaller angle from the vertical, more light from the chip-on-board LED package 182 is directed in a downward direction to illuminate a surface area that is closer to the area immediately below the fixture 100. Alternatively, if the combined orientation of the upper reflector 141 and the lower reflector 144 is directed at a larger angle from the vertical, more light from the chip-on-board LED package 182 is directed outwardly to illuminate a surface area that is further from the area immediately below the fixture 100. Thus, the upper reflector 141 is independently adjustable in orientation and dimensions along its circumferential path. Similarly, the lower reflector 144 is independently adjustable in orientation and dimensions along its circumferential path. Hence, some exemplary embodiments are not rotationally symmetric about the housing central axis 116.

Figure 5A:
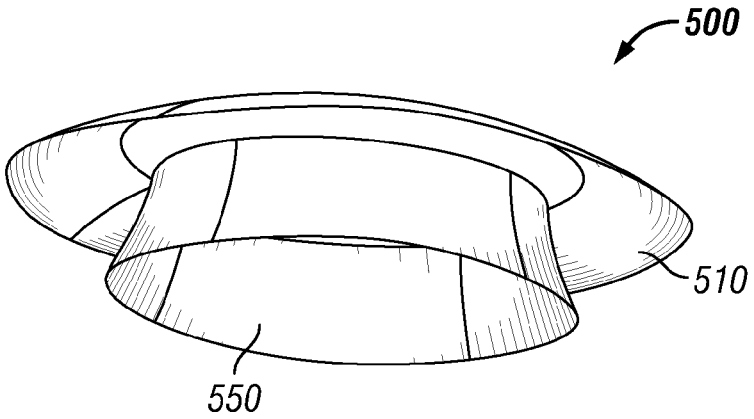
FIG. 5A is a perspective view of a dual-reflector assembly in accordance with another exemplary embodiment of the present invention.
Figure 5B:
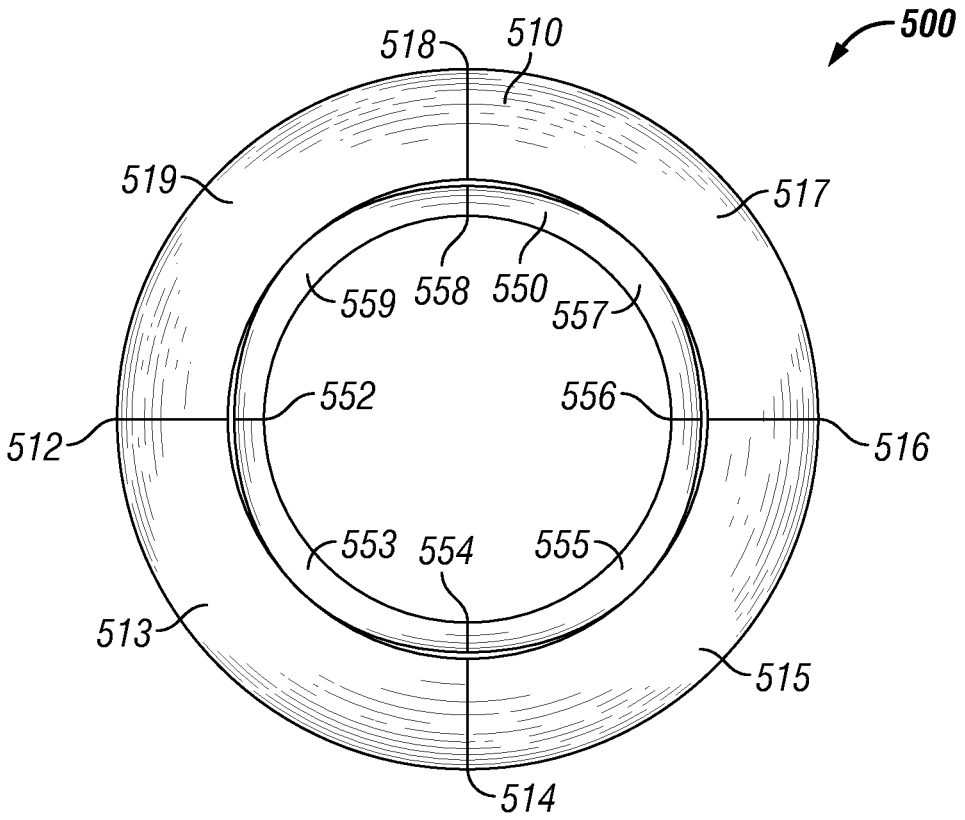
FIG. 5B is a top plan view of the dual-reflector assembly of FIG. 5A in accordance with another exemplary embodiment of the present invention.
Figure 5C:
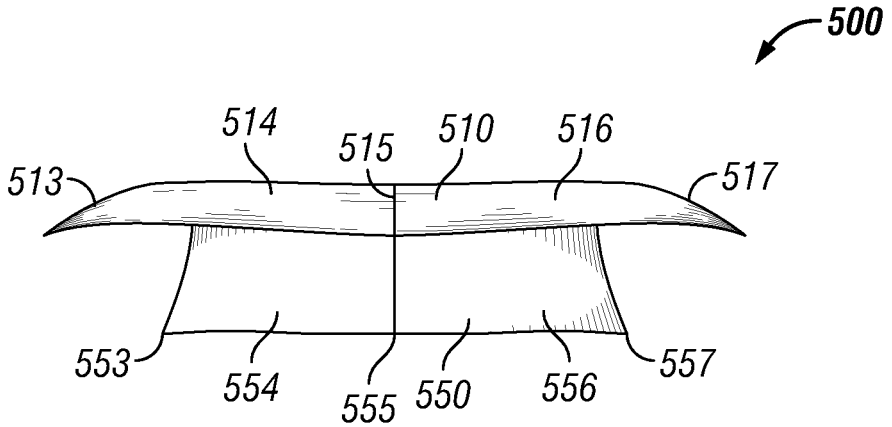
FIG. 5C is a side elevation view of the dual-reflector assembly of FIG. 5A in accordance with another exemplary embodiment of the present invention.

FIG. 5A is a perspective view of a dual-reflector assembly 500 in accordance with another exemplary embodiment of the present invention. FIG. 5B is a top plan view of the dual-reflector assembly 500 in accordance with another exemplary embodiment of the present invention. FIG. 5C is a side elevation view of the dual-reflector assembly 500 in accordance with another exemplary embodiment of the present invention. Referring to FIGS. 5A-5C, the dual-reflector assembly 500 includes an upper reflector 510 and a lower reflector 550. The upper reflector 510 is similar to the upper reflector 141 (FIG. 1C), except that certain portions of the upper reflector 510 has been extended when compared to the upper reflector 141 (FIG. 1C). Similarly, the lower reflector 550 is similar to the lower reflector 144 (FIG. 1C), except that certain portions of the lower reflector 550 has been extended when compared to the lower reflector 144 (FIG. 1C). Additionally, portions of both the upper reflector 510 and the lower reflector 550 have been collectively reoriented so that they are directed at a higher angle when compared to the orientation of the upper reflector 141 (FIG. 1C) and lower reflector 144 (FIG. 1C). The dual-reflector assembly 500 is designed to produce a square-shaped illumination pattern.

The upper reflector 510 includes an upper reflector first side profile 512, an upper reflector second side profile 514, an upper reflector third side profile 516, and an upper reflector fourth side profile 518. According to the exemplary embodiment, each of the upper reflector first, second, third, and fourth side profiles 512, 514, 516, and 518 are shaped and oriented the same; however, the upper reflector first, second, third, and fourth side profiles 512, 514, 516, and 518 are shaped and/or oriented differently from one another in other exemplary embodiments. Each of the upper reflector first, second, third, and fourth side profiles 512, 514, 516, and 518 are positioned about ninety degrees from one another; however the positioning is variable in other exemplary embodiments.

Similarly, the lower reflector 550 includes a lower reflector first side profile 552, a lower reflector second side profile 554, a lower reflector third side profile 556, and a lower reflector fourth side profile 558. According to the exemplary embodiment, each of the lower reflector first, second, third, and fourth side profiles 552, 554, 556, and 558 are shaped and oriented the same; however, the lower reflector first, second, third, and fourth side profiles 552, 554, 556, and 558 are shaped and/or oriented differently from one another in other exemplary embodiments. Each of the lower reflector first, second, third, and fourth side profiles 552, 554, 556, and 558 are positioned about ninety degrees from one another; however the positioning is variable in other exemplary embodiments. In the exemplary embodiment, the lower reflector first, second, third, and fourth side profiles 552, 554, 556, and 558 are aligned directly below the upper reflector first, second, third, and fourth side profiles 512, 514, 516, and 518, respectively.

The upper reflector 510 also includes an upper reflector first corner profile 513, an upper reflector second corner profile 515, an upper reflector third corner profile 517, and an upper reflector fourth corner profile 519. According to the exemplary embodiment, each of the upper reflector first, second, third, and fourth corner profiles 513, 515, 517, and 519 are shaped and oriented the same; however, the upper reflector first, second, third, and fourth corner profiles 513, 515, 517, and 519 are shaped and/or oriented differently from one another in other exemplary embodiments. Each of the upper reflector first, second, third, and fourth corner profiles 513, 515, 517, and 519 are positioned about ninety degrees from one another and centrally between adjacent upper reflector first, second, third, and fourth side profiles 512, 514, 516, and 518, respectively; however, the positioning is variable in other exemplary embodiments.

Similarly, the lower reflector 550 also includes a lower reflector first corner profile 553, a lower reflector second corner profile 555, a lower reflector third corner profile 557, and a lower reflector fourth corner profile 559. According to the exemplary embodiment, each of the lower reflector first, second, third, and fourth corner profiles 553, 555, 557, and 559 are shaped and oriented the same; however, the lower reflector first, second, third, and fourth corner profiles 553, 555, 557, and 559 are shaped and/or oriented differently from one another in other exemplary embodiments. Each of the lower reflector first, second, third, and fourth corner profiles 553, 555, 557, and 559 are positioned about ninety degrees from one another and centrally between adjacent lower reflector first, second, third, and fourth side profiles 552, 554, 556, and 558, respectively; however, the positioning is variable in other exemplary embodiments. In the exemplary embodiment, the lower reflector first, second, third, and fourth corner profiles 553, 555, 557, and 559 are aligned directly below the upper reflector first, second, third, and fourth corner profiles 513, 515, 517, and 519, respectively.

According to some embodiments, the upper reflector 510 is extended outwardly further at each of the upper reflector first, second, third, and fourth corner profiles 513, 515, 517, and 519 than at each of the upper reflector first, second, third, and fourth side profiles 512, 514, 516, and 518. Similarly, the lower reflector 550 is extended outwardly further at each of the lower reflector first, second, third, and fourth corner profiles 553, 555, 557, and 559 than at each of the lower reflector first, second, third, and fourth side profiles 552, 554, 556, and 558. Additionally, in some embodiments, the orientation of the upper reflector 510 and the lower reflector 550 is at a higher angle at each of the corner profiles 513, 515, 517, 519, 553, 555, 557, and 559 than at each of the side profiles 512, 514, 516, 518, 552, 554, 556, and 558. This allows light to be emitted at further distances at the corner profiles 513, 515, 517, 519, 553, 555, 557, and 559 than at the side profiles 512, 514, 516, 518, 552, 554, 556, and 558. Hence, a square-shape distribution pattern is achieved in this exemplary embodiment. In some exemplary embodiments, the shape and orientation of the upper reflector 510 and the lower reflector 550 in areas between the corner profiles 513, 515, 517, 519, 553, 555, 557, and 559 and the side profiles 512, 514, 516, 518, 552, 554, 556, and 558 are adjusted to provide for a smooth transition between the corner profiles 513, 515, 517, 519, 553, 555, 557, and 559 and the side profiles 512, 514, 516, 518, 552, 554, 556, and 558.

Figure 6:
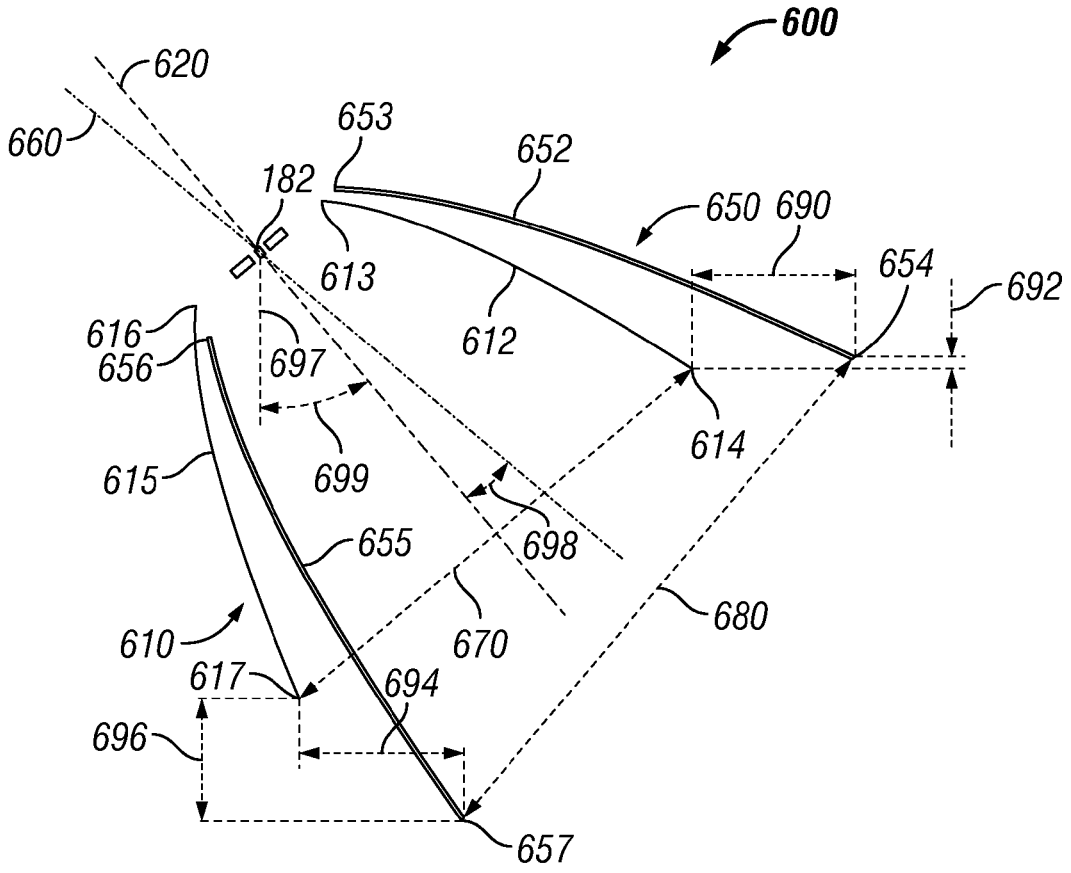
FIG. 6 presents an overlapping cross-sectional view of a portion of a side profile cross-sectional view of the upper reflector and the lower reflector and a portion of a corner profile cross-sectional view of the upper reflector and the lower reflector of the dual-reflector assembly of FIG. 5A in accordance with another exemplary embodiment of the present invention.

FIG. 6 shows an overlapping cross-sectional view 600 of a portion of a side profile cross-sectional view 610 of the upper reflector 510 (FIG. 5B) and the lower reflector 550 (FIG. 5B) and a portion of a corner profile cross-sectional view 650 of the upper reflector 510 (FIG. 5B) and the lower reflector 550 (FIG. 5B) of the dual-reflector assembly 500 (FIG. 5B) in accordance with another exemplary embodiment of the present invention. Referring to FIGS. 5A-6, the corner profile cross-sectional view 650 is formed at each of the corner profiles 513, 515, 517, 519, 553, 555, 557, and 559 (FIG. 5B), while the side profile cross-sectional view 610 is formed at each of the side profiles 512, 514, 516, 518, 552, 554, 556, and 558 (FIG. 5B).

The corner profile cross-sectional view 650 includes a corner profile upper cross-sectional edge 652 and a corner profile lower cross-sectional edge 655. The corner profile upper cross-sectional edge 652 illustrates the shape and orientation of the upper reflector 510 at the upper reflector corner profiles 513, 515, 517, 519 (FIG. 5B). The corner profile lower cross-sectional edge 655 illustrates the shape and orientation of the lower reflector 550 at the lower reflector corner profiles 552, 554, 556, and 558 (FIG. 5B). The corner profile upper cross-sectional edge 652 includes a corner profile upper proximal edge 653 at one end and a corner profile upper distal end 654 at an opposing end. Similarly, the corner profile lower cross-sectional edge 655 includes a corner profile lower proximal edge 656 at one end and a corner profile lower distal end 657 at an opposing end. A corner profile axis 660 is formed, which passes through the center point between the corner profile upper proximal edge 653 and the corner profile lower proximal edge 656 and the center point between the corner profile upper distal end 654 and the corner profile lower distal end 657.

Similarly, the side profile cross-sectional view 610 includes a side profile upper cross-sectional edge 612 and a side profile lower cross-sectional edge 615. The side profile upper cross-sectional edge 612 illustrates the shape and orientation of the upper reflector 510 at the upper reflector side profiles 512, 514, 516, 518 (FIG. 5B). The side profile lower cross-sectional edge 615 illustrates the shape and orientation of the lower reflector 550 at the lower reflector side profiles 552, 554, 556, and 558 (FIG. 5B). The side profile upper cross-sectional edge 612 includes a side profile upper proximal edge 613 at one end and a side profile upper distal end 614 at an opposing end. Similarly, the side profile lower cross-sectional edge 615 includes a side profile lower proximal edge 616 at one end and a side profile lower distal end 617 at an opposing end. A side profile axis 620 is formed, which passes through the center point between the side profile upper proximal edge 613 and the side profile lower proximal edge 616 and the center point between the side profile upper distal end 614 and the side profile lower distal end 617.

FIG. 6 also illustrates exemplary relationships between the side profile cross-sectional view 610 and the corner profile cross-sectional view 650. The distance between the side profile upper distal end 614 and the side profile lower distal end 617 forms a side profile distal diameter 670, which is about 3.8 inches; however, in other exemplary embodiments, the side profile distal diameter 670 is more or less than 3.8 inches depending upon the desired illumination pattern. The distance between the corner profile upper distal end 654 and the corner profile lower distal end 657 forms a corner profile distal diameter 680, which is about 4.5 inches; however, in other exemplary embodiments, the corner profile distal diameter 680 is more or less than 4.5 inches depending upon the desired illumination pattern. The distance between the side profile upper distal end 614 and the corner profile upper distal end 654 has an upper x-component distance 690 and a upper y-component distance 692. The upper x-component distance 690 is about 1.2 inches, however, in other exemplary embodiments, the upper x-component distance 690 is more or less than 1.2 inches depending upon the desired illumination pattern. The upper y-component distance 692 is about 0.1 inches, however, in other exemplary embodiments, the upper y-component distance 692 is more or less than 0.1 inches depending upon the desired illumination pattern. The distance between the side profile lower distal end 617 and the corner profile lower distal end 657 has a lower x-component distance 694 and a lower y-component distance 696. The lower x-component distance 694 is about 1.2 inches, however, in other exemplary embodiments, the lower x-component distance 694 is more or less than 1.2 inches depending upon the desired illumination pattern. The lower y-component distance 696 is about 0.9 inches, however, in other exemplary embodiments, the lower y-component distance 696 is more or less than 0.9 inches depending upon the desired illumination pattern.

The chip-on-board LED package 182 is positioned where the side profile axis 620 and the corner profile axis 660 intersect when the side profile cross-sectional view 610 is superimposed onto the corner profile cross-sectional view 650. The side profile axis 620 and the corner profile axis 660 form a differential angle 698. The differential angle 698 is about ten degrees; however, the differential angle 698 is larger or smaller in other exemplary embodiments. The side profile axis 620 intersects with a perpendicular axis 697 to form a side profile orientation angle 699. The side profile orientation angle 699 is about forty degrees; however, the side profile orientation angle 699 is larger or smaller in other exemplary embodiments. Thus, a corner profile orientation angle (not shown) is formed between the corner profile axis 660 and the perpendicular axis 697. The corner profile orientation angle is about fifty degrees; however, the corner profile orientation angle is larger or smaller in other exemplary embodiments.

Although each exemplary embodiment has been described in detail, it is to be construed that any features and modifications that are applicable to one embodiment are also applicable to the other embodiments. Although the invention has been described with reference to specific embodiments, these descriptions are not meant to be construed in a limiting sense. Various modifications of the disclosed embodiments, as well as alternative embodiments of the invention will become apparent to persons of ordinary skill in the art upon reference to the description of the exemplary embodiments. It should be appreciated by those of ordinary skill in the art that the conception and the specific embodiments disclosed may be readily utilized as a basis for modifying or designing other structures or methods for carrying out the same purposes of the invention. It should also be realized by those of ordinary skill in the art that such equivalent constructions do not depart from the spirit and scope of the invention as set forth in the appended claims. It is therefore, contemplated that the claims will cover any such modifications or embodiments that fall within the scope of the invention.

What is claimed is:

1. A dual-reflector assembly, comprising:

an upper reflector comprising an upper reflector proximal end and an upper reflector distal end, the upper reflector proximal end being positioned elevationally above the upper reflector distal end;

a lower reflector comprising a lower reflector proximal end and a lower reflector distal end, the lower reflector proximal end being positioned elevationally above the lower reflector distal end, wherein the lower reflector proximal end is closer to the upper reflector proximal end than the lower reflector distal end is to the upper reflector distal end; and one or more light sources positioned substantially between the upper reflector proximal end and the lower reflector proximal end, the one or more light sources oriented to face an aperture formed between the upper reflector distal end and the lower reflector distal end and emit light through the aperture, wherein the one or more light sources are aimed at a space between the lower reflector distal end and the upper reflector distal end; and wherein at least a portion of the upper reflector surrounds at least a portion of the lower reflector.

2. The dual-reflector assembly of claim 1, wherein the upper reflector comprises an upper reflector axial axis, wherein the lower reflector comprises a lower reflector axial axis, and wherein the upper reflector axial axis and the lower reflector axial axis are the same.

3. The dual-reflector assembly of claim 2, wherein the upper reflector and the lower reflector are rotationally symmetrical around the upper reflector axial axis.

4. The dual-reflector assembly of claim 2, wherein the upper reflector and the lower reflector are rotationally asymmetrical around the upper reflector axial axis.

5. The dual-reflector assembly of claim 4, wherein the upper reflector and the lower reflector comprises one or more side profiles and one or more corner profiles, wherein the upper reflector and the lower reflector are oriented at a higher angle at the corner profiles than at the side profiles.

6. The dual-reflector assembly of claim 4, wherein the upper reflector and the lower reflector comprises one or more side profiles and one or corner profiles, wherein the upper reflector and the lower reflector are longer in length at the corner profiles than at the side profiles.

7. The dual-reflector assembly of claim 1, wherein the upper reflector and the lower reflector form a cross-sectional profile, a portion of the cross-sectional profile being substantially cup-shaped.

8. The dual-reflector assembly of claim 7, wherein the cross-sectional profile is oriented at an angle ranging between about twenty degrees to about seventy degrees.

9. The dual-reflector assembly of claim 1, further comprising one or more substrates, the substrate being coupled to at least a portion of the upper reflector proximal end and to at least a portion of the lower reflector proximal end.

10. The dual-reflector assembly of claim 9, wherein the light source comprises one or more chip-on-board LED packages, the chip-on-board LED packages being coupled to the substrate.

11. A luminaire, comprising:

a housing comprising an interior surface, an exterior surface, and a cavity formed therebetween; the housing forming an opening along the exterior surface;

a dual-reflector assembly positioned within the housing, the dual-reflector assembly comprising:

an upper reflector comprising an upper reflector proximal end and an upper reflector distal end, the upper reflector proximal end being positioned elevationally above the upper reflector distal end;

a lower reflector comprising a lower reflector proximal end and a lower reflector distal end, the lower reflector proximal end being positioned elevationally above the lower reflector distal end wherein the lower reflector proximal end is closer to the upper reflector proximal end than the lower reflector distal end is to the upper reflector distal end; and a plurality of light sources positioned substantially between the upper reflector proximal end and the lower reflector proximal end, the plurality of light sources oriented to face an aperture formed between the upper reflector distal end and the lower reflector distal end and emit light through the aperture and the opening, the aperture and the opening being substantially aligned; and a driver electrically coupled to the light sources, wherein at least a portion of the upper reflector surrounds at least a portion of the lower reflector.

12. The luminaire of claim 11, wherein a lower portion of the interior surface forms the lower reflector.

13. The luminaire of claim 11, wherein the housing further comprises a divider extending between the interior surface and the exterior surface, the divider separating the cavity into a first compartment and a second compartment, the divider comprising a first member and a second member, the second member forming the upper reflector.

14. The luminaire of claim 13, wherein the driver is coupled to the housing within the first compartment.

15. The luminaire of claim 11, further comprising a heat sink, at least a portion of the heat sink being positioned within a channel axially formed through the center of the housing, the heat sink being coupled to a portion of the housing.

16. The luminaire of claim 11, further comprising a lens coupled to portions of the housing and being disposed over the opening.

17. The luminaire of claim 11, wherein the upper reflector comprises an upper reflector axial axis, wherein the lower reflector comprises a lower reflector axial axis, and wherein the upper reflector axial axis and the lower reflector axial axis are the same.

18. The luminaire of claim 17, wherein the upper reflector and the lower reflector are rotationally symmetrical around the upper reflector axial axis.

19. The luminaire of claim 17, wherein the upper reflector and the lower reflector are rotationally asymmetrical around the upper reflector axial axis.

20. The luminaire of claim 19, wherein the upper reflector and the lower reflector comprise one or more side profiles and one or corner profiles, wherein the upper reflector and the lower reflector are oriented at a higher angle at the corner profiles than at the side profiles.

21. The luminaire of claim 19, wherein the upper reflector and the lower reflector comprise one or more side profiles and one or corner profiles, wherein the upper reflector and the lower reflector are longer in length at the corner profiles than at the side profiles.

22. The luminaire of claim 11, wherein the upper reflector and the lower reflector form a cross-sectional profile, a portion of the cross-sectional profile being substantially cup-shaped.

23. The luminaire of claim 22, wherein the cross-sectional profile is oriented at an angle ranging between about twenty degrees to about seventy degrees.

24. The luminaire of claim 11, further comprising one or more substrates, the substrate being coupled to at least a portion of the upper reflector proximal end and to at least a portion of the lower reflector proximal end, and wherein the light source comprises one or more chip-on-board LED packages, the chip-on-board LED packages being coupled to the substrate.

25. A method of forming a shape and orientation of a dual-reflector assembly comprising an upper reflector having an upper reflector proximal end and an upper reflector distal end, and a lower reflector having a lower reflector proximal end and a lower reflector distal end, wherein the lower reflector proximal end is closer to the upper reflector proximal end than the lower reflector distal end is to the upper reflector distal end, the method comprising:

placing a reflector a predetermined distance away from a rotational axis, the reflector comprising an upper edge profile and a lower edge profile;

orienting the reflector at a peak angle;

rotating the reflector around the rotational axis;

obtaining the shape and orientation of the upper reflector from the rotating upper edge profile;

obtaining the shape and orientation of the lower reflector from the rotating lower edge profile, and placing one or more light sources between the upper reflector proximal end and the lower reflector proximal end, the one or more light sources oriented to face an aperture formed between the upper reflector distal end and the lower reflector distal end and emit light through the aperture.

26. The method of claim 25, further comprising maintaining the predetermined distance between the reflector and the rotational axis as the reflector is rotated around the rotational axis.

27. The method of claim 25, further comprising varying the predetermined distance between the reflector and the rotational axis as the reflector is rotated around the rotational axis.

28. The method of claim 25, wherein the orientation of the reflector is maintained as the reflector is rotated around the rotational axis.

29. The method of claim 25, wherein the orientation of the reflector is varied as the reflector is rotated around the rotational axis.

30. The method of claim 25, wherein the length of the upper edge profile and the lower edge profile is maintained as the reflector is rotated around the rotational axis.

31. The method of claim 25, wherein the length of at least one of the upper edge profile and the lower edge profile is varied as the reflector is rotated around the rotational axis.

32. The method of claim 25, wherein the reflector comprises a cup reflector.

* * * * *